US006491550B1

(12) United States Patent
Murasawa

(10) Patent No.: US 6,491,550 B1
(45) Date of Patent: Dec. 10, 2002

(54) ENTERTAINMENT SYSTEM CAPABLE OF DISCRIMINATING MODEL OF OPERATION DEVICE, OPERATION DEVICE, AND MACHINE BODY OF ENTERTAINMENT SYSTEM

(75) Inventor: Osamu Murasawa, Tokyo (JP)

(73) Assignee: Sony Computer Entertainment, Inc. (JP)

( * ) Notice: Subject to any disclaimer, the term of this patent is extended or adjusted under 35 U.S.C. 154(b) by 250 days.

(21) Appl. No.: 09/656,856

(22) Filed: Sep. 7, 2000

(30) Foreign Application Priority Data

Sep. 9, 1999 (JP) ..... 11-255608

(51) Int. Cl.[7] ..... H01R 24/00; H01R 33/00

(52) U.S. Cl. ..... 439/660; 439/166; 439/956; 273/148 B

(58) Field of Search ..... 439/166, 660, 439/924.1, 956, 489; 273/148 B

(56) References Cited

U.S. PATENT DOCUMENTS 5,759,100 A * 6/1998 Nakanishi ..... 273/148 B

FOREIGN PATENT DOCUMENTS

| | | | |
|---|---|---|---|
| EP | 0940162 | 9/1999 | |
| EP | 1134853 A1 * | 9/2001 | ..... H01R/13/64 |
| JP | 6274137 | 9/1994 | |
| JP | 9212446 | 8/1997 | |
| JP | 10187342 | 7/1998 | |
| WO | WO 96/12250 | 4/1996 | |

* cited by examiner

*Primary Examiner*—Brian Sircus
*Assistant Examiner*—Hae Moon Hyeon
(74) *Attorney, Agent, or Firm*—Lerner, David, Littenberg, Krummholz & Mentlik, LLP

(57) ABSTRACT

The present invention provides an entertainment system in which the models can be discriminated between compatible operation devices. A connector of the operation device of the present invention comprises at least two recess portions on the peripheral surface thereof, and a connecting portion of a machine body is provided with at least two metal projections arranged thereon to be engaged with the respective recesses. The connector includes a metal plate, and the metal plate is exposed inside of the first recess and the second recess. A supplying portion of the machine body supplies a predetermined potential to the metal plate by supplying the predetermined potential to the first metal projection engaged with the first recess. A detecting portion of the machine body determines whether the connected operation device is the operation device or not by detecting a potential of the second metal projection engaged with the second recess.

8 Claims, 11 Drawing Sheets

CROSS SECTION TAKEN ALONG THE LINE A-A

CROSS SECTION TAKEN ALONG THE LINE B-B

CROSS SECTION TAKEN ALONG THE LINE C-C

CROSS SECTION TAKEN ALONG THE LINE D-D

OPEN STATE

GROUNDED STATE

ENTERTAINMENT SYSTEM CAPABLE OF DISCRIMINATING MODEL OF OPERATION DEVICE, OPERATION DEVICE, AND MACHINE BODY OF ENTERTAINMENT SYSTEM

This application claims a priority based on Japanese Patent Application No. 11-255608 filed on Sep. 9, 1999, the entire contents of which are incorporated herein by reference for all purposes.

BACKGROUND OF THE INVENTION

The present invention relates to an entertainment system using a operation device connected thereto.

An entertainment system to be used by connecting to the external display is disclosed in Japanese Patent Laid-Open No. 7-313730. The entertainment system comprises, as shown in FIG. 1, a machine body 10 having an optical disk reproducing section 1, and an operation device 20 for accepting the user's operations connected thereto. A processing unit within the machine body 10 receives a game program and image information etc. recorded in the optical disc from the optical disk reproducing section 1 and displays the image on the external display. The processing unit communicates with the operation device 20, to accept contents of the user's oprations, executes a game program according to the accepted user's controls, and changes the display images etc.

The operation device 20 comprises a operation body 22 having switches 24–29 arranged thereon for receiving the user's operations, a cable 23, and a connector 21. The operation unit 20 is connected with respect to each other by inserting the connector 21 into the connecting portions 4*a* and 4*b* of the machine body 10 as shown in FIG. 1, FIG. 2, and FIG. 3.

The connector 21 comprises nine pins 601 therein as shown in FIGS. 5A, 5B, and 5C. On the upper surface of an inserting portion 501 of the connector 21, there are provided retaining portions 502, 503, and 504 for preventing the connector 21 from being detached from the connecting portions 4*a* and 4*b* of the machine body 10 as shown in FIG. 4. The retaining portions 502, 503, and 504 are recesses to engage with the metal projection provided within the connecting portions 4*a* and 4*b*. A grounding metal 505 is inserted on the bottom surface of the recess of the retaining portion 503 located in the center, and is exposed from the bottom surface of the retaining portion 503. The grounding metal 505 is supplied with a ground potential when it comes into contact with the metal projection at the ground potential provided on the machine body 10 to be engaged therewith. Therefore, the retaining portion 503 located in the center serves not only as a retaining portion, but also as a grounding terminal.

The machine body 10 is also provided with receiving portions 3*a*, 3*b* for a card-type external memory device device 30 to be mounted thereon, and switches 11, 12.

SUMMARY OF THE INVENTION

In recent years, the development of the operation device 20 has been pursued to produce a new model by making improvement to the operation device 20 described above, for example, by increasing the number of operations that are accepted by the switches 24–29 of the operation device body 22, or by increasing communication speed between the operation device 20 and the machine body 10. However, since it is preferable to ensure compatibility between the operation device of the new model and that of the conventional model in order to enhance convenience, the connector of the operation device for the new model should have the same configuration as that of the connector of the conventional operation device 20.

On the other hand, the machine body cannot support all the communication modes for each model, unless the machine body can discriminate whether the connected operation device is the conventional model or the new model. In general, a pin is added to the new model for discriminating the new model from the conventional one. However, adding such a pin to the operation device of the new model changes the configuration of the connector, whereby the compatibility cannot be established. In order to ensure the compatibility as well as discrimination of the model, there requires such a structure that can discriminate the model types while maintaining the configuration of the connector as it was in the conventional model.

SUMMARY OF THE INVENTION

Accordingly, it is an object of the present invention to provide an entertainment system that can discriminate the models between the compatible operation devices.

In order to achieve the object described above, the following entertainment system is provided according to the present invention. That is, an entertainment system comprising an operation device having a connector, and a machine body having a connecting portion to be connected to said connector wherein:

- the connector is provided with a plurality of recesses on the peripheral surface thereof, said plurality of recesses including the first recess and the second recess;
- the connecting portion is provided with a plurality of metal projections to be engaged with the plurality of recesses respectively, the plurality of metal projections including the first metal projection to be engaged with the first recess and the second metal projection to be engaged with the second recess;
- the connector includes a metal plate, and the metal plate is exposed inside of at least the first recess and the second recess; and
- the machine body has a supplying portion for supplying a predetermined potential to the first metal projection for supplying the predetermined potential to the metal plate and a detecting portion for detecting whether a potential of the second metal projection is equal to the predetermined potential or not in order to detect whether the operation device connected to the connecting portion is said operation device or not.

DESCRIPTION OF THE PREFERRED EMBODIMENTS

The entertainment system according to an embodiment of the present invention will now be described.

Figure 1:
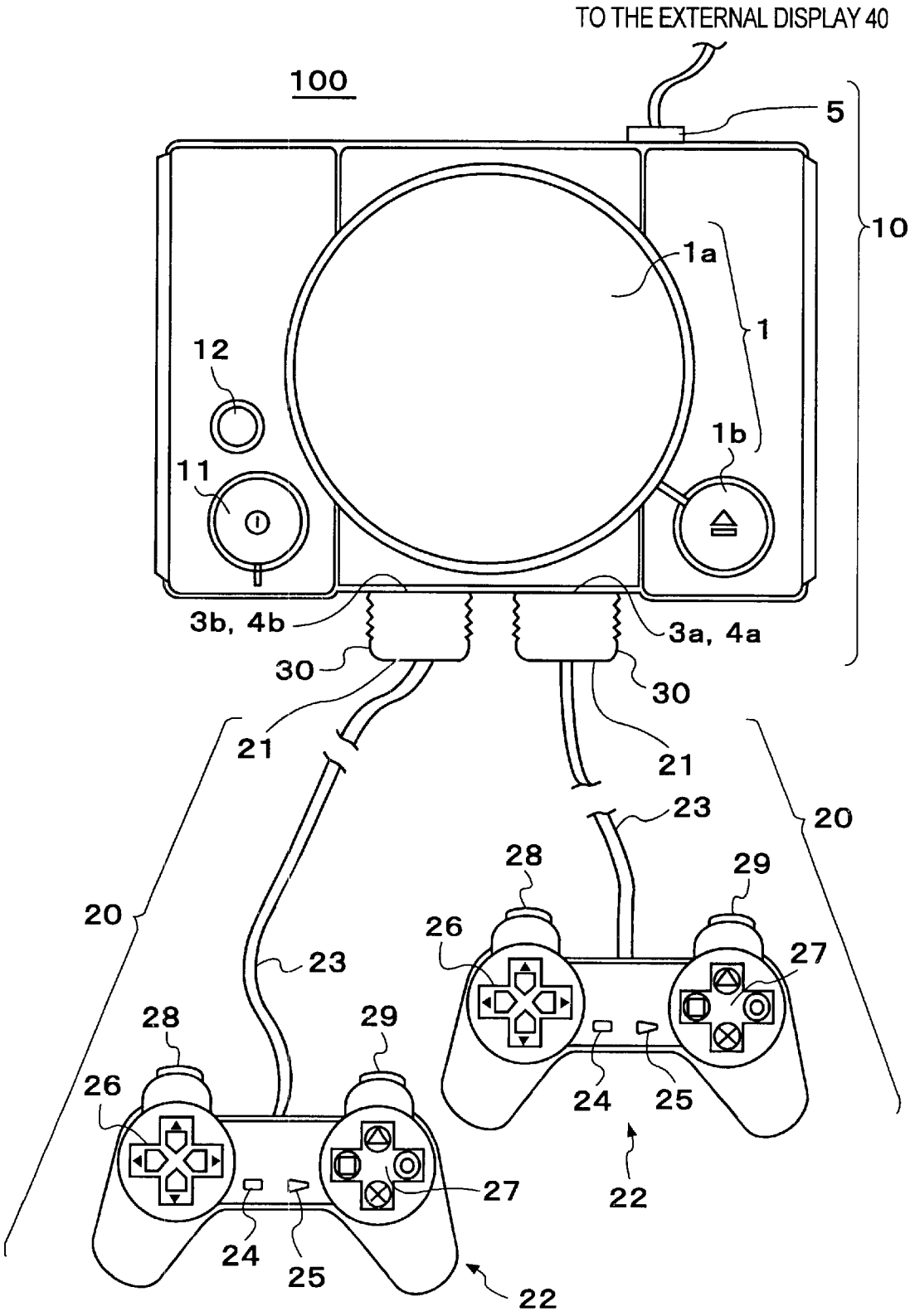
FIG.1 ( PRIOR ART )
FIG. 1 is a top view showing an entire structure of the conventional entertainment system 100.
Figure 2:
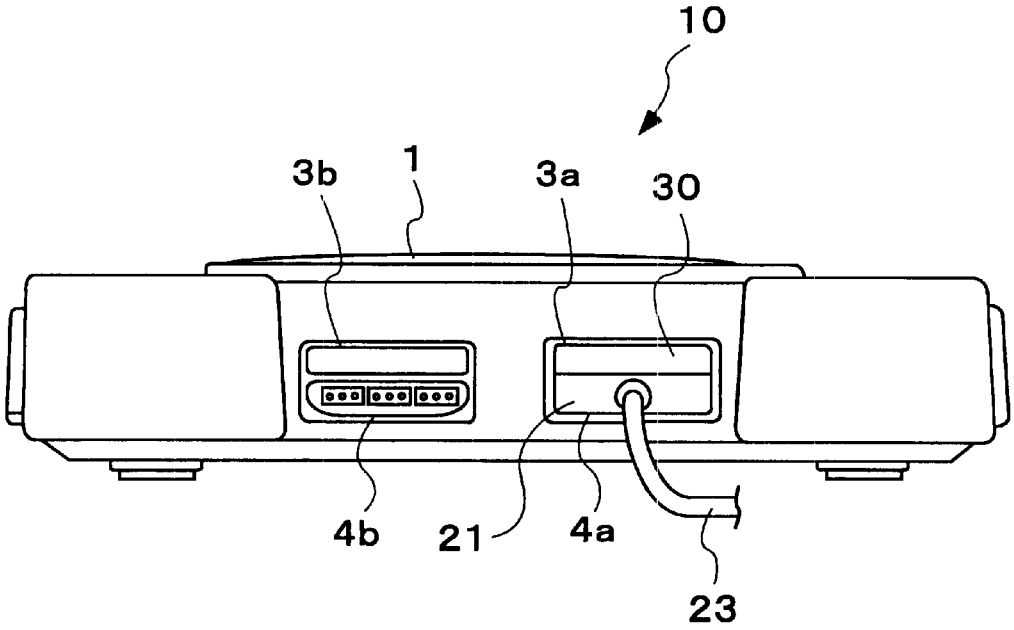
FIG.2 ( PRIOR ART )
FIG. 2 is a side view showing a configuration of a front face of the entertainment system 100 shown in FIG. 1.
Figure 3:
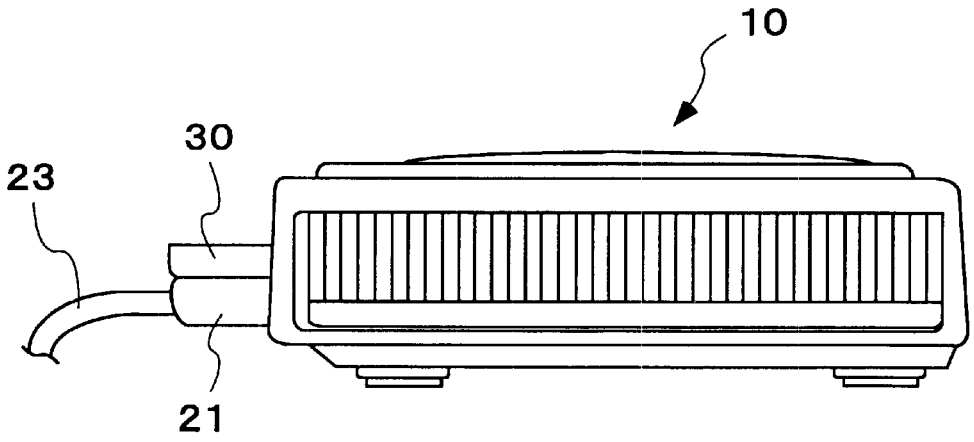
FIG.3 ( PRIOR ART )
FIG. 3 is a side view showing a configuration of a side of the entertainment system 100 shown in FIG. 1.
Figure 4:
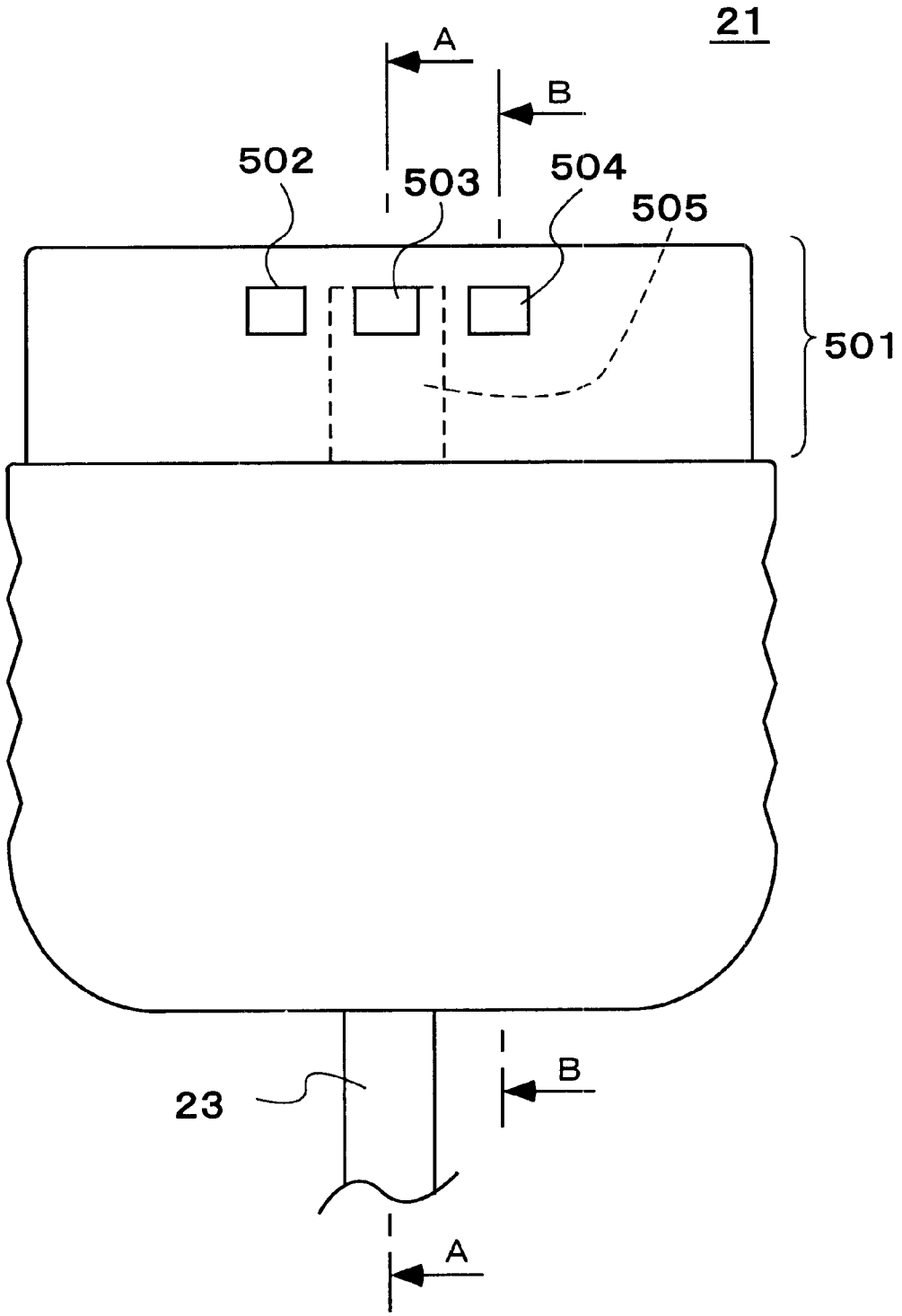
FIG.4 (PRIOR ART)
FIG. 4 is a top view showing a structure of a connector 21 of the operation device 20 for the entertainment system 100 shown in FIG. 1.
Figure 5A:
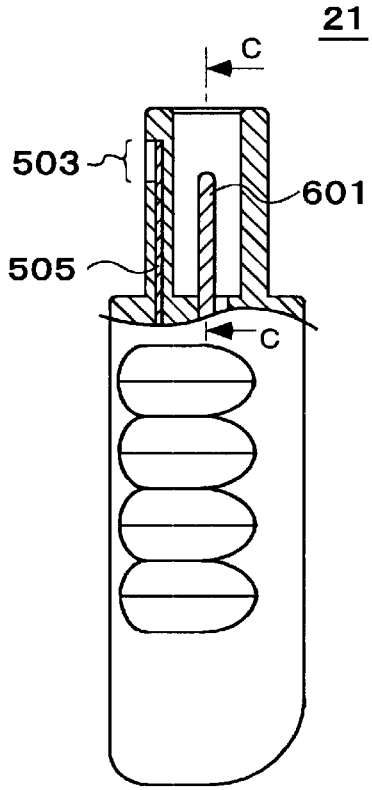
FIG.5A ( PRIOR ART )
FIG. 5A is a cross sectional view of the connector 21 of FIG. 4 taken along the line A—A.
Figure 5B:
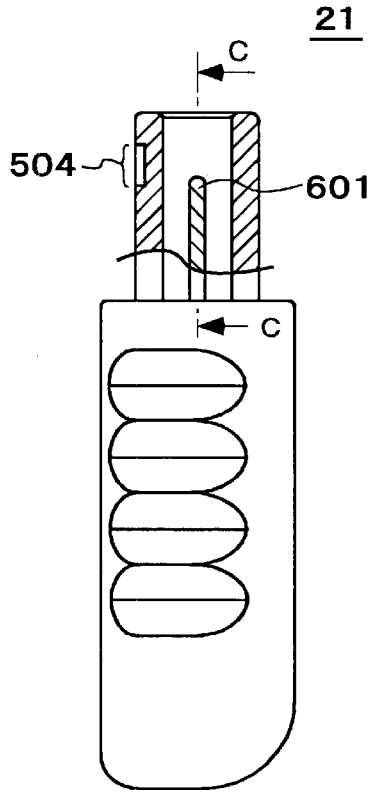
FIG.5B ( PRIOR ART )
FIG. 5B is a cross sectional view of the connector 21 of FIG. 4 taken along the line B—B.
Figure 5C:
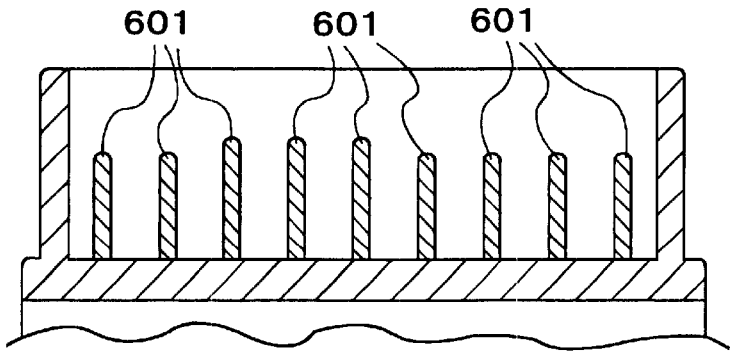
FIG.5C ( PRIOR ART )
FIG. 5C is a cross sectional view of the connector 21 of FIG. 5A and FIG. 5B taken along the line C—C.
Figure 6:
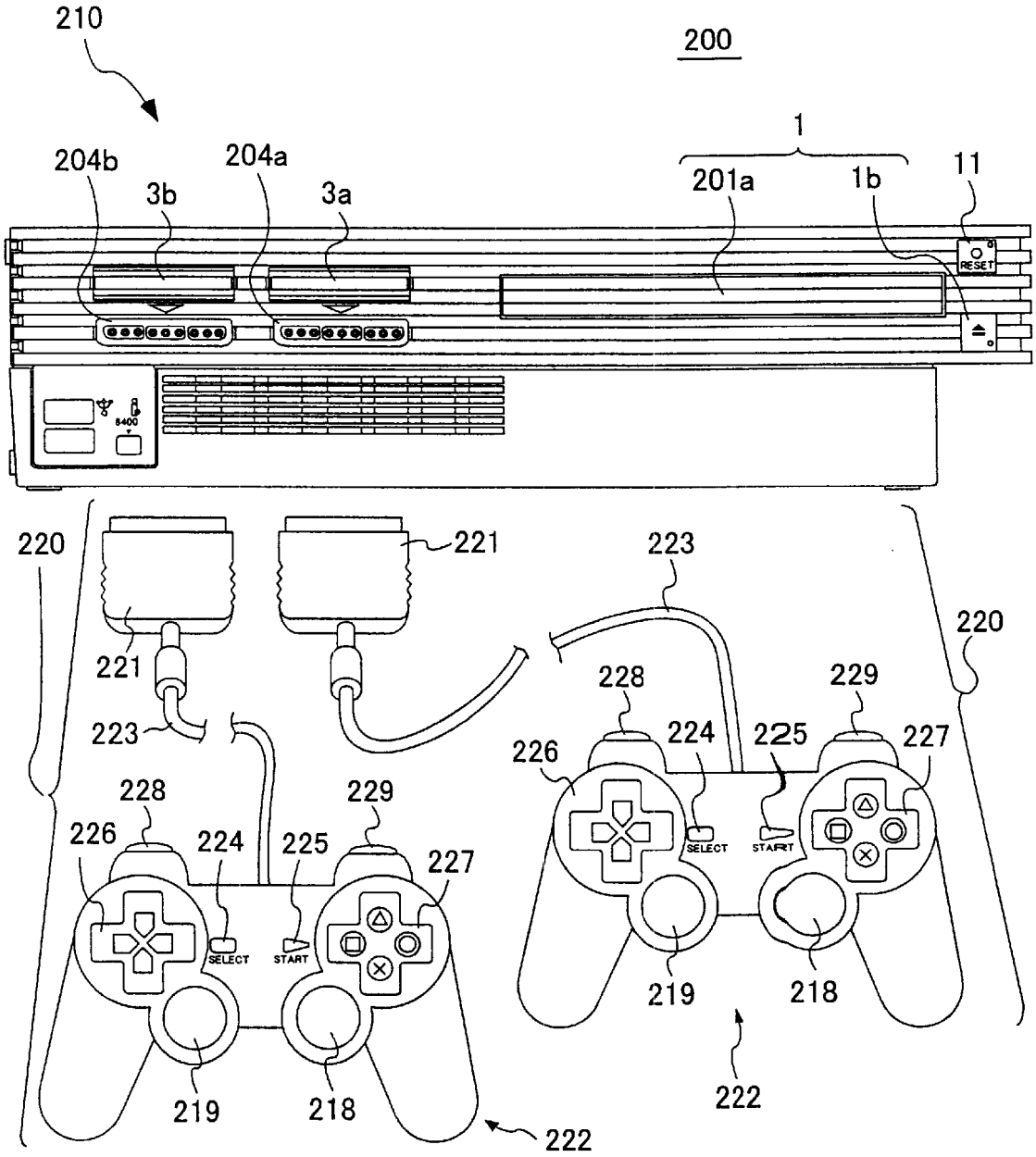
FIG. 6 is a front view showing a machine body 210 of the entertainment system 200 and a top view showing the operation device 220 according to an embodiment of the present invention.
Figure 7:
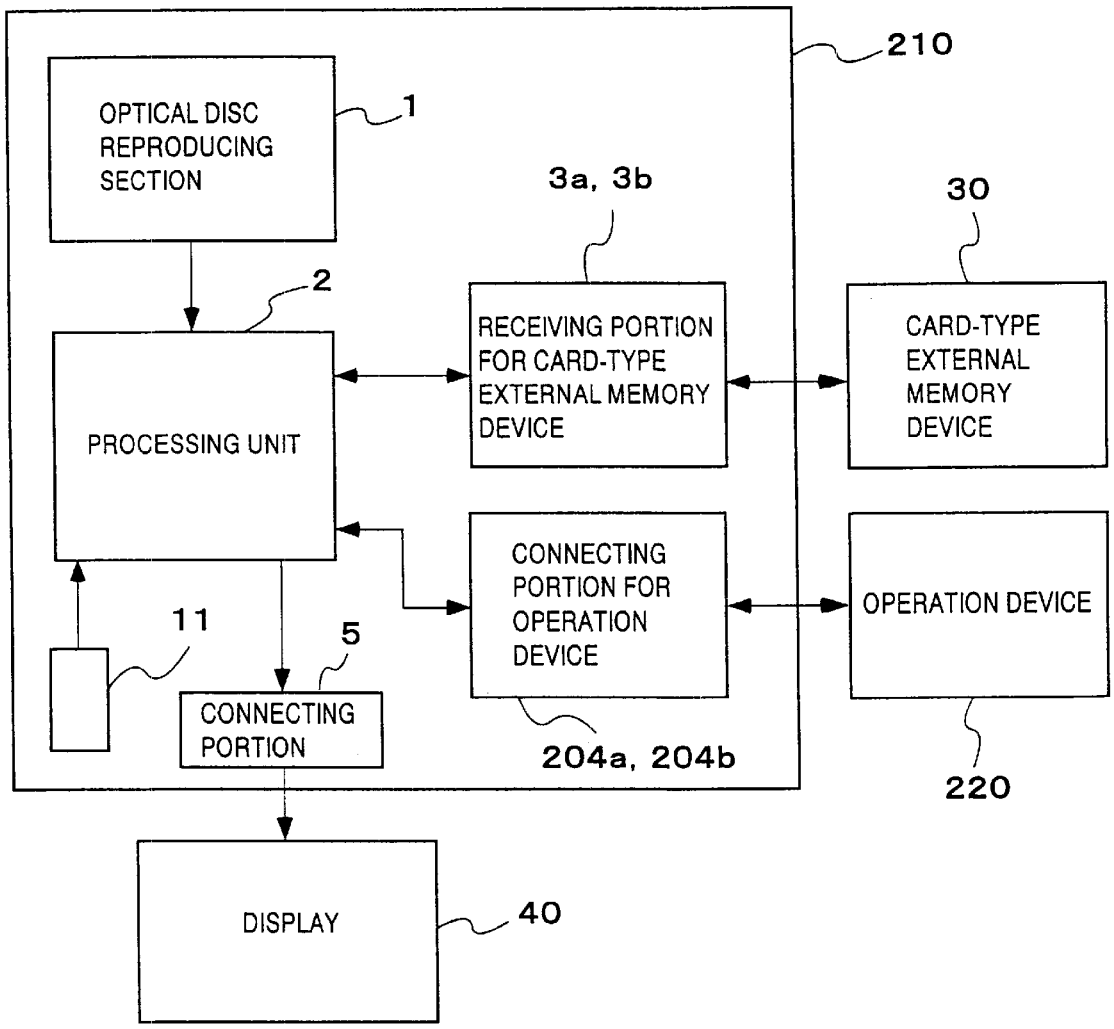
FIG. 7 is a block diagram showing the machine body 210 of the entertainment system 200 of FIG. 6.

The entertainment system 200 of this embodiment is a series of models, which are systematized members of the entertainment system 100 shown in FIG. 1. The entertainment system 200 of this embodiment comprises, as shown in FIG. 6 and FIG. 7, a machine body 210 and an operation device 220 detachably connected to the machine body 210. The machine body 210 comprises, as in FIG. 7, the optical disk reproducing portion 1, an arithmetic processing unit 2, card-type exterior memory device receiving portions 3*a* and 3*b*, operation device connecting portions 204*a* and 204*b*, a switch 11, and a display connecting portion 5.

The operation device 220 is a device for accepting the user's operations, one or two of which can be connected to the connecting portions 204*a* and 204*b* of the machine body 210. The operation device 220 comprises an operation device body 222 having a press down type switches 224–229, and lever-type switches 218 and 219 for accepting the user's operations, a cable 223, and a connector 221. The machine body 210 and the operation device 220 are connected by inserting the connector 221 into the connecting portions 204*a* and 204*b* of the machine body 210. The operation device 220 is a high performance device wherein the switches 218, 219, 224–229 are capable of accepting a larger number of types of oprations than the conventional operation device 20. In addition, the communication speed between the operation device 220 and the machine body 210 is higher than that between the conventional operation device 20 and the machine body 10, and the communication procedure is also different.

The arithmetic processing unit 2 of the machine body 210 has a capability of communicating in a communicating procedure that is adapted to the operation device 20 and in a communicating procedure that is adapted to the operation device 220.

Figure 8:
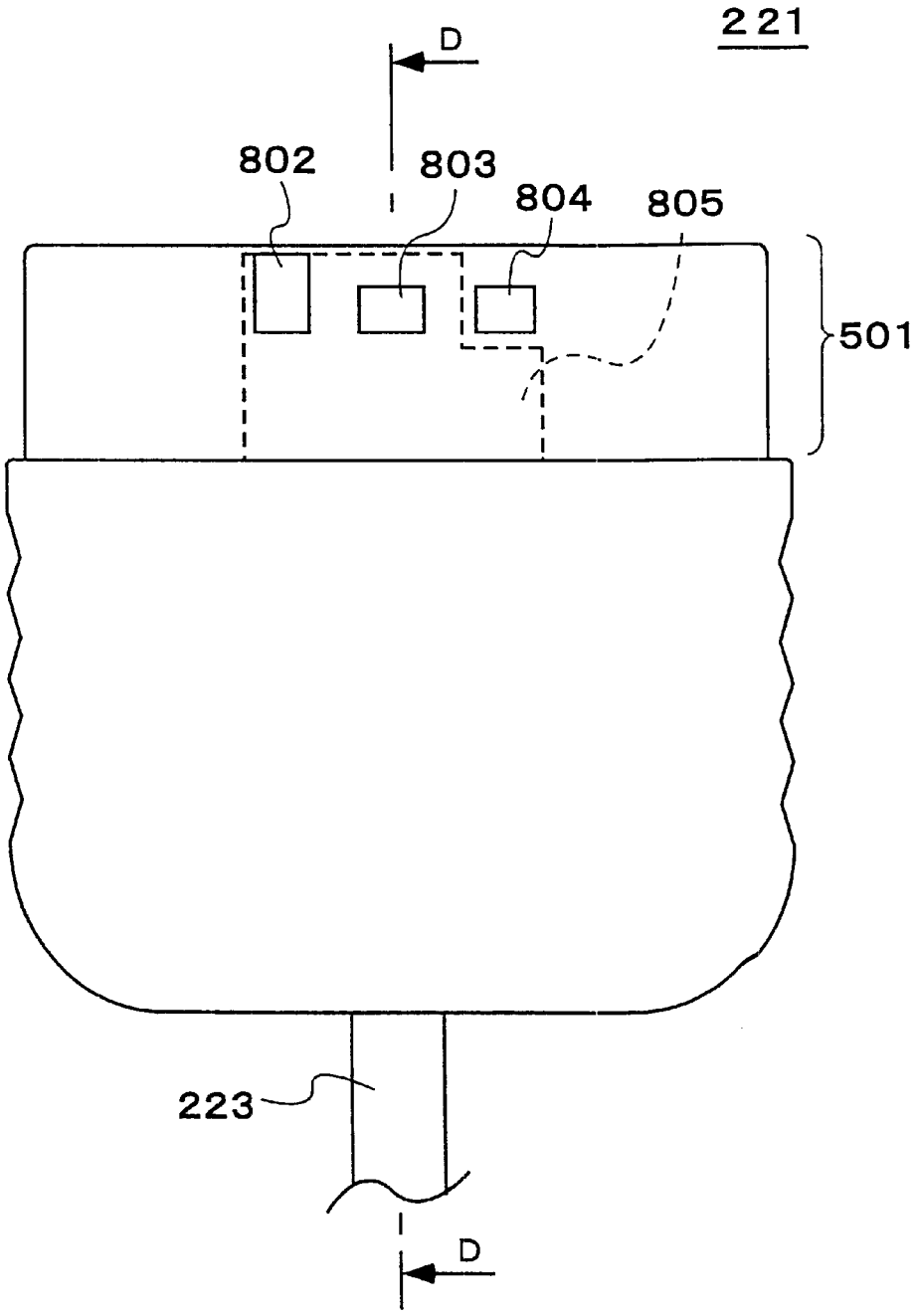
FIG. 8 is a top view showing a structure of the connector 221 of the operation device 220 for the entertainment system 200 shown in FIG. 6.
Figure 9:
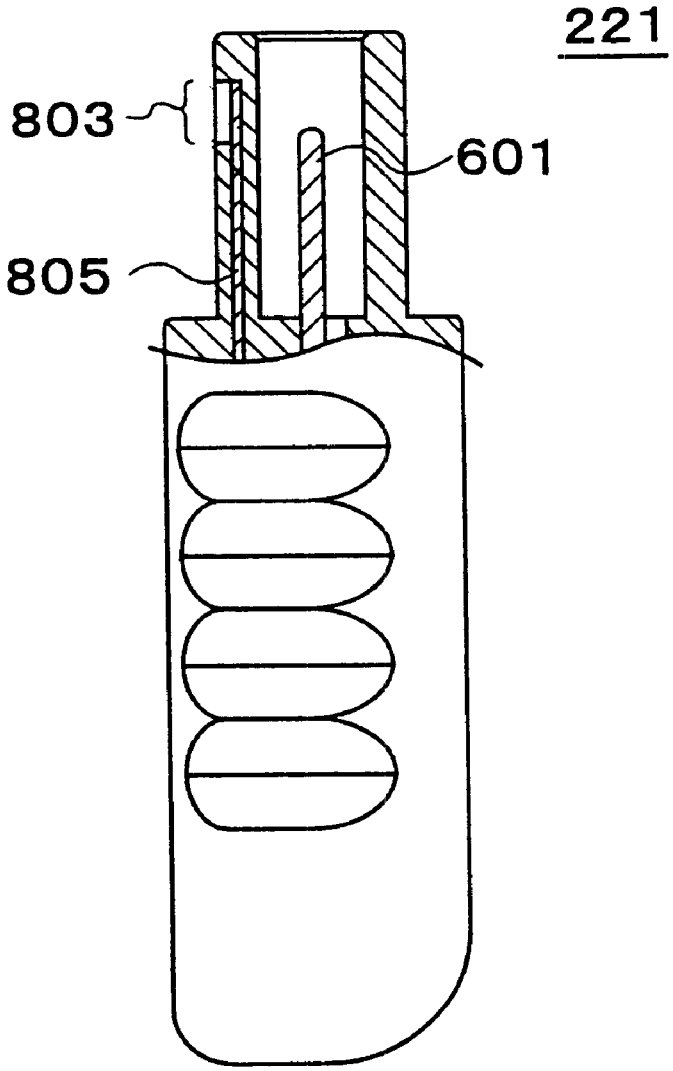
FIG. 9 is a cross sectional view of the connector 221 of FIG. 8 taken along the line D—D.

The connector 221 of the operation device 220 has the same profile as the conventional connector 21 shown in FIG. 4, FIGS. 5A, 5B, and 5C, and the number of the pins 601 provided therein and the spacing between adjacent pins are the same as the conventional connector. As shown in FIG. 8, the upper surface of an inserting portion 501 of the connector 221 is provided with retaining portions 802, 803, and 804 of the same configuration and at the same position as retaining portions 502, 503, and 504 of the conventional connector 21.

The connector 221 of this embodiment differs from the conventional connector 21 in that the width of the grounding metal 805 is wider, and in that the grounding metal 805 is inserted not only to the bottom surface of the central retaining portion 803, but also to the bottom surface of the retaining portion 802. Therefore, the grounding metal 805 is exposed on the bottom surfaces of the retaining portions 802 and 803. The recess of the retaining portion 802 has an elongated configuration toward the tip of the inserting portion 501, and the grounding metal 805 is exposed on the retaining portion 802 until the vicinity of the tip. The grounding metal 805 is connected to the electromagnetic shielding (not shown) within the connector 221. The grounding metal 805 in itself serves as an electromagnetic shield for the inserting portion 501.

On the other hand, the front face of the machine body 210 is provided with connecting portions 204*a* and 204*b* for connecting the connector 221 of the operation device 220. As described above, since the connector 221 of the operation device 220 has the same configuration as the connector 21 of the conventional operation device 20, the connector 21 of the conventional operation device 20 can be connected to the connecting portions 204*a* and 204*b* of the machine body.

Figure 10:
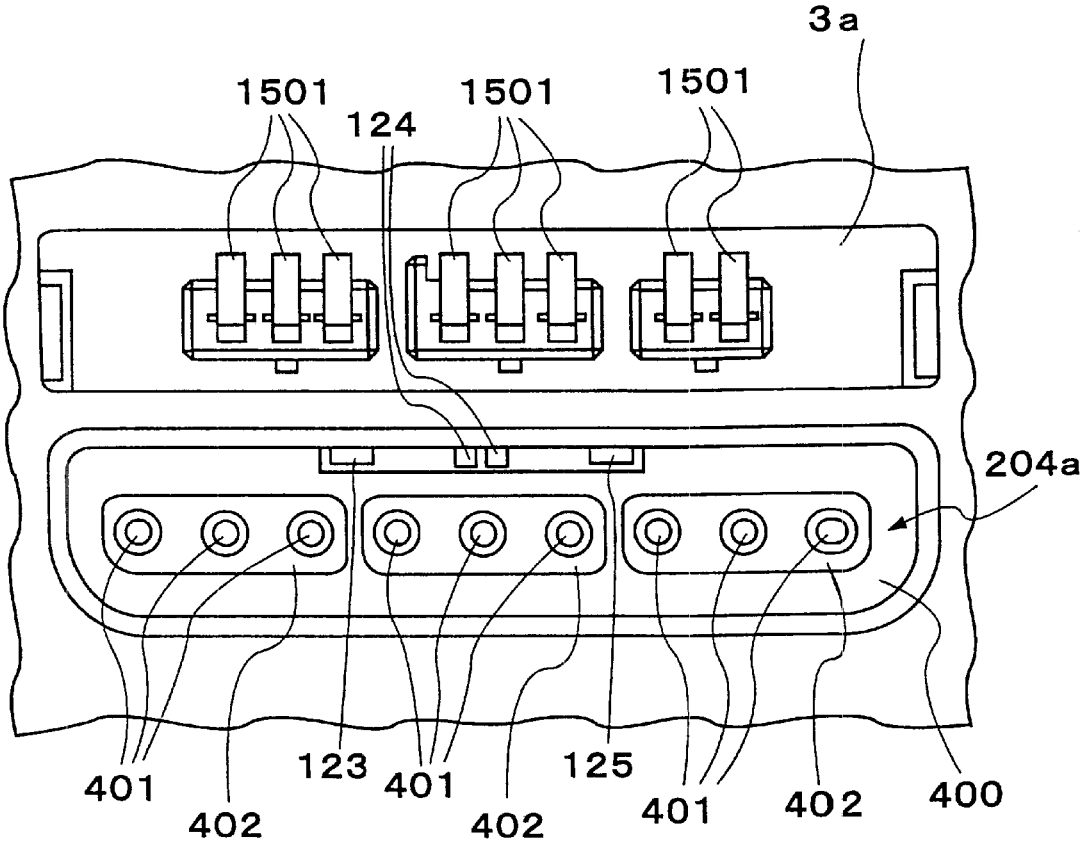
FIG. 10 is a front view of a receiving portion 3*a* (in the state where a shutter is removed) and a connecting portion 204*a* of the machine body 210 of the entertainment system 200 shown in FIG. 6.
Figure 11:
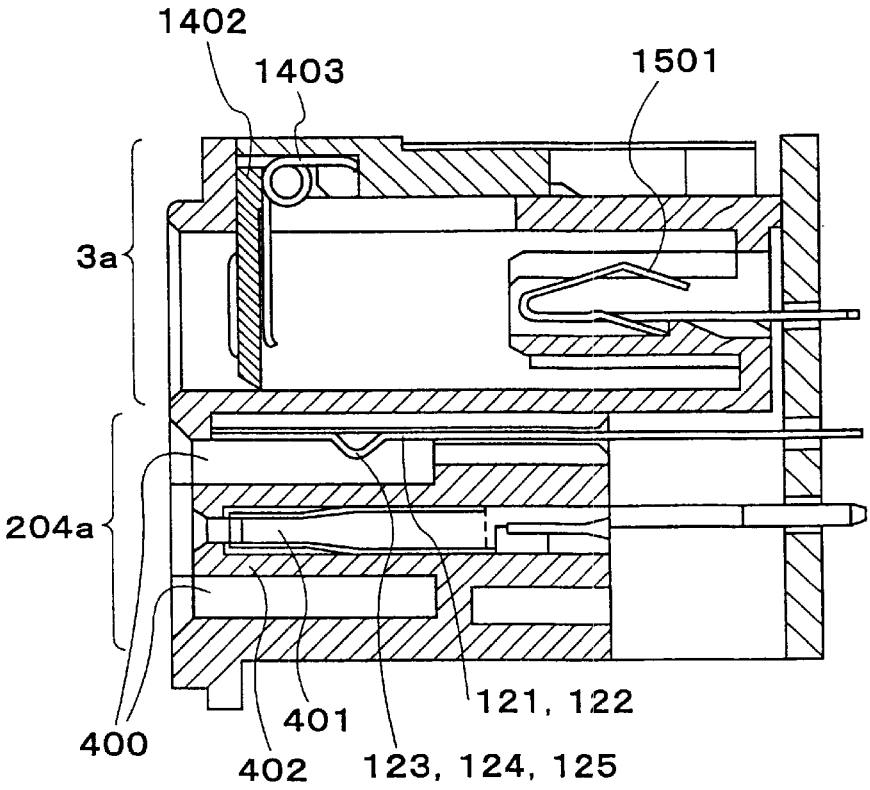
FIG. 11 is a cross sectional view of the receiving portion 3*a* and the connecting portion 204*a* of the machine body 210 of the entertainment system 200 shown in FIG. 6.
Figure 12:
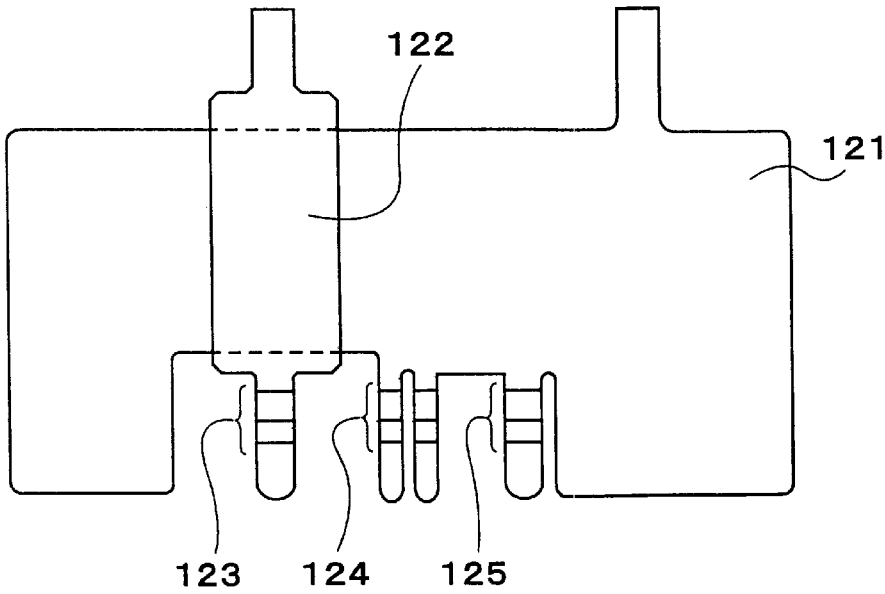
FIG. 12 is a top view showing a configuration of the metal plates 121, 122 disposed on the connecting portion 204*a* shown in FIG. 10.

The connecting portion 204*a* is, as shown in FIG. 10 and FIG. 11, provided with three bases 402 within the opening 400, and nine cylindrical terminals 401 are arranged in the bases 402. The cylindrical terminal 401 is connected to the nine pins 601 of the connector 21, 221. At the upper part of the opening 400, there are provided with metal plates 121, 122 of the shape as shown in FIG. 12 arranged without contact with respect to each other.

The metal plate 121 is formed with lever shaped projections 124, 125 at two points, while the metal plate 122 is formed with a lever shaped projection 123 at one point. These projections 123, 124, and 125 are protrude inward the opening 400 in a line as shown in FIG. 10. The central projection 124 is divided into two pieces in order to provide two contact points.

Figure 13A:
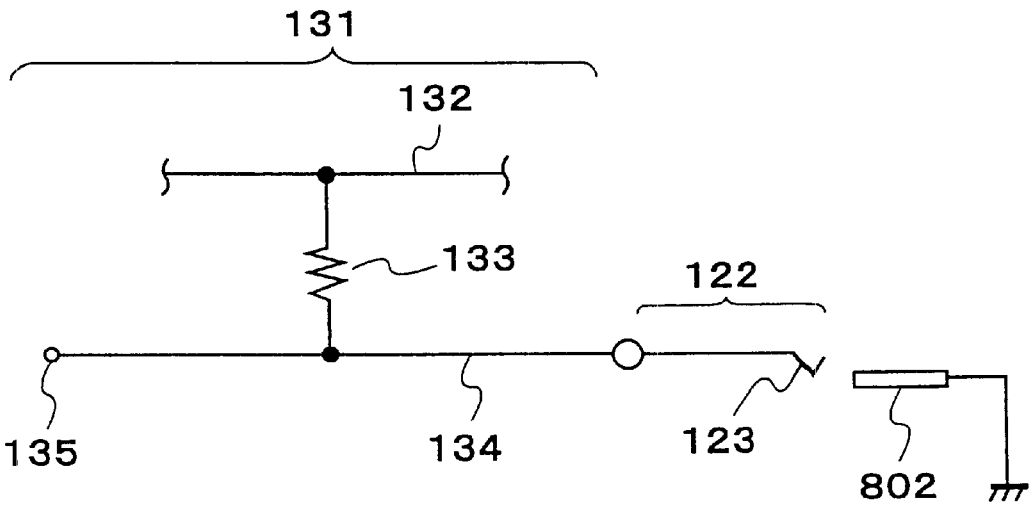
FIG. 13A is a schematic circuit diagram showing the open state of the pull-up circuit of the machine body 210 of the entertainment system 200 shown in FIG. 6.
Figure 13B:
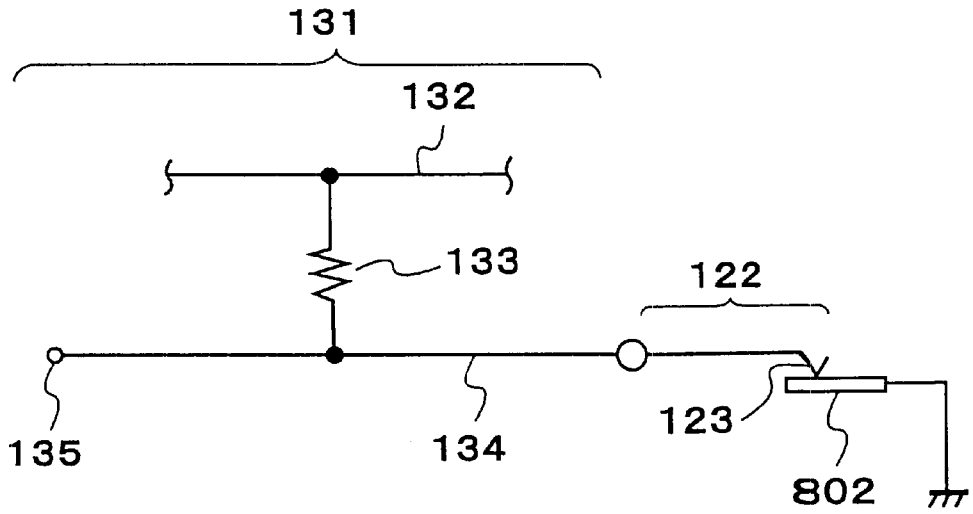
FIG. 13B is a schematic circuit diagram showing the grounded state of the pull-up circuit of the machine body 210 of the entertainment system 200 shown in FIG. 6.

The metal plate 121 is electrically connected to the ground cable within the machine body 210. The metal plate 122 is connected to a pull-up circuit 131 as shown in FIG. 13A. The pull-up circuit 131 comprises wiring 134 connected to the metal plate 122, a signal line 132 at a signal potential, and a resistance 133 connecting the signal line 132 at a signal potential and the wiring 134. Therefore, when the metal plate 122 is in an open state where it is not in contact with other signal lines as shown in FIG. 13A, the wiring 134 will be equal to the signal potential of the signal line 132, thus pulling up the potential of the signal line 132 to the signal potential. On the other hand, when the metal plate 122 comes into contact with the metal at a ground potential as shown in FIG. 13B, the potential of the signal line 134 is fallen down to a ground potential. The terminal 135 of the wiring 134 is connected to the arithmetic processing unit 2 in the machine body 210, and the processing unit 2 has a function to determine whether the potential of the terminal 135 is at the signal potential or at the ground potential by executing a program within the inner memory device at predetermined time intervals.

Since the structure of the connecting portion 204*b* is the same as that of the connecting portion 204*a*, description about the connecting portion 204*b* will not be made here.

In the entertainment system 200 of this embodiment, when the connector 221 of the operation device 220 is inserted into the connecting portion 204*a* of the machine body 210, the inserting portion 501 of the connector 221 is fitted in a clearance between the opening 400 of the connecting portion 204*a* and the base 402. Accordingly, the projections 123, 124, and 125 are engaged with the retaining portions 802, 803, and 804 provided on the upper surface of the connector 221 respectively, so that the connector 221 is locked to the connecting portion 204*a*. The nine pins 601 of the connector 221 are connected with the nine cylindrical terminals 401 in the base 402.

In this case, while the rightmost retaining portion 804 out of three retaining portions 802, 803, and 804 is connected with the projection 125 only mechanically since it does not have a grounding metal 805 exposed on the bottom surface thereof, other two retaining portions 802 and 803 are connected with the projections 123 and 124 not only mechanically but also electrically since these two retaining portions 802 and 803 have a grounding metal 805 exposed on the bottom surfaces thereof.

The retaining portion 802 is formed until the vicinity of the tip of the inserting portion 501, so that the projection 123 of the metal plate 122 is electrically connected to the grounding metal 805 exposed on the bottom surface of the retaining portion 802 when the connector 221 is inserted. At this point of time, since the potential of the grounding metal 802 is not fallen down to the ground level, the signal line 134 of the pull-up circuit 131 is still at a signal potential. When the connector 221 is inserted deeper, the projection 124 comes into contact with the grounding metal 805 on the bottom surface of the retaining portion 803 electrically, whereby the potential of the grounding metal 805 and thus of the metal plate 122 connected to the grounding metal 805 fall down to a ground level, as shown in FIG. 13B. Therefore, the signal line 134 of the pull-up circuit 131 changes from the signal potential to the ground potential. The processing unit 2 determines that the potential of the terminal 135 of the signal line 134 is fallen down to the ground level, thereby detecting that the connected operation device is the operation device 220. Therefore, the processing unit 2 can conduct communications in the communication procedure adapted to the operation device 220, and receive opration information from the operation device 220 via the pins 601 and the terminals 401.

As the potential of the grounding metal 805 falls down to the ground level, the potential of the electromagnetic shield connected to the grounding metal 805 falls down to the ground level as well, thereby functioning as an electromagnetic shield. The grounding metal 805 in itself prevents electromagnetic waves from leaking through the inserting portion 501, and serves as a part of an electromagnetic shield.

On the other hand, when the connector 21 of the operation device 20 for the conventional model is inserted into the connecting portion 204*a*, since the connector 21 is the same as the connector 221 in configuration, the inserting portion 501 of the connector 21 is fitted in a clearance between the opening 400 of the connecting portion 204*a* and the base 402, so that the nine pins 601 of the connector 221 can be connected to the nine cylindrical terminals 401 of the base 402. The projections 123, 124, and 125 of the connecting portion 204*a* engage with the retaining portions 502, 503, and 504 of the conventional connector 21 and the connector 221 is retained in the connecting portion 204*a*. Since the grounding metal 505 exposed on the bottom surface of the central retaining portion 503 comes into electrical contact with the projection 124 of the metal plate 121 at the ground potential, the potential of the grounding metal 505 falls down to the ground level. Accordingly, the potential of the electromagnetic shield connected to the grounding metal 505 falls to the ground level as well, thereby serving as an electromagnetic shield. The grounding metal 505 in itself serves as an electromagnetic shield that shields the connector 21.

However, the projection 123 connected to the pull-up circuit 131 is engaged with the retaining portion 502 only mechanically because the grounding metal 505 is not exposed on the bottom surface of the retaining portion 502, whereby it cannot be connected to the grounding metal 505 electrically. Therefore, the signal line 134 of the pull-up circuit 131 remains at the signal potential. The processing unit 2 determines that the terminal 135 of the signal line 134 is still at the signal potential, thereby detecting that the connected operation device is the operation device 20. Then the processing unit 2 can conduct communications in the communication mode adapted to the operation device 20 and receive opration information from the operation device 20 via the pins 601 and the terminals 401.

In this way, in the operation device 220 of this embodiment, the configuration of the connector 221 is the same as the conventional connector 21, but the grounding metal 805 is exposed from a plurality of retaining portions 802 and 803. Therefore, whether the model of the connected operation device is the operation device 220 or the conventional operation device 20 can be determined depending on whether the machine body 210 can detect the ground potential at one of the exposed portion of the grounding metal 805 or not. In this way, since the operation device 220 is improved only in that the number of the locations of the grounding metal 805 exposed is increased, and thus the number of the terminals 601 is not increased, the configuration of the connector 221 may be maintained as in the conventional connector 21, thereby ensuring compatibility between the operation device 20 and the operation device 220. In addition, the machine body 210 can detect the model of the connected operation device by the metal plate 122 and the pull-up circuit 131, whereby communications can be conducted in the communication mode that is adapted to the performance of the operation device. Since the pull-up circuit 131 and the metal plate 122 are simple in construction, it can be arranged in the machine body 210 easily at low cost.

Now, the structures and operations of the other components of the entertainment system 200 will be briefly described.

The optical disk reproducing section 1 of the machine body 210 comprises a disk tray 201*a*, a switch 1*b*, an axis of rotation, a rotary drive, a playback head, and a reproducing circuit. The disk tray 201*a* is, as shown in FIG. 6, arranged on the front face of the machine body 210, and ejected toward the front by pressing the switch 1*b*. By placing the optical disk in which a game program and images or the like to be displayed are recorded in advance on the disk tray

201*a*, and then retracting the disk tray 201*a* within the machine body 210, the optical disk is loaded into the machine body 210. The rotary drive rotates the axis of rotation to allow the playback head to read information recorded therein. The switch 1*b* is a switch to withdraw the disk tray 201*a*. The reset switch 11 is also provided on the front face of the machine body 210.

Above the connecting portions 204*a* and 204*b* on the front face of the machine body 210, there are provided receiving portions 3*a* and 3*b* for mounting a card-type external memory device 30, as shown in FIG. 6. The receiving portions 3*a* and 3*b* are provided with terminals 1501 as shown in FIG. 10 and FIG. 11. The terminals 1501 are brought into contact with a connecting terminal on the mounted card-type external memory device 30. At the entrance of the receiving portion 3*a*, 3*b*, there is provided a shutter 1402 that is closed by a force of the spring 1403 when the card-type external memory device 30 is not mounted.

The user connects the external display 40 to the connecting portion 5 of the machine body 210, and the operation device 20 or 220 to the connecting portions 204*a* and 204*b*, when the user plays game by the entertainment system 200. Then the user turns the power source switch, not shown, ON, places an optical disk on the disk tray 201 of the optical disk reproducing section 1 to load it. Then the processing unit 2 of the machine body 210 receives the game program or image information etc. recorded on the optical disk from the optical disk regenerating section 1 and displays it on the external display 40. The processing unit 2 detects whether the connected operation device is the operation device 20 or the operation device 220 by determining whether the potential of the terminal 135 of the pull-up circuit 131 is at the signal potential or at the ground potential as described above, and then conducts communications with the operation device in the communication mode adapted to the model of the detected operation device to receive contents of the user's operations. The processing unit 2 changes the displaying image by executing a game program according to the received contents of the operations. The processing unit 2 communicates with the card-type external memory device 30 when the card-type external memory device 30 is mounted into the receiving portion 3*a* and 3*b* to read game information stored in the card-type external memory device 30, thereby reflecting it to the execution of the game program. At the same time, the processing unit 2 stores game information into the card-type external memory device 30 according to he game program.

As is described thus far, the entertainment system of this embodiment is very convenient for the user because any one of the operation device 20 and the operation device 20, which are different in model, may be connected to the machine body 210. In addition, whether the connected operation device is the operation device 20 or the operation device 220 may be easily detected by the machine body, whereby the machine body 210 can conduct communications in the communication procedure adapted to the connected model of the operation device 20 or 220. Therefore, the operation device and the machine body can conduct communications by making the most of the performances of the operation device 20 and 220.

As explained above, according to the present invention, there is provided the entertainment system that can discriminate the model of compatible operation devices can.

What is claimed is:

1. An entertainment system comprising an operation device having a connector, and a machine body having a connecting portion to be connected to said connector wherein:

said connector is provided with a plurality of recesses on the peripheral surface thereof, said plurality of recesses including a first recess and a second recess;

said connecting portion is provided with a plurality of metal projections to be engaged with said plurality of recesses respectively, said plurality of metal projections including a first metal projection to be engaged with said first recess and a second metal projection to be engaged with said second recess;

said connector includes a metal plate, and said metal plate is exposed inside of at least said first recess and said second recess; and said machine body has a supplying portion for supplying a predetermined potential to said first metal projection for supplying said predetermined potential to said metal plate and a detecting portion for detecting whether a potential of said second metal projection is equal to said predetermined potential or not in order to detect whether the operation device connected to said connecting portion is said operation device or not.

2. An entertainment system as set forth in claim 1, wherein said machine body comprises a processing portion that conducts communications with an operation device connected to said connecting portion;

said processing portion is provided with a function to conduct communications in a first and a second communication procedures;

said processing portion determines that said operation device is connected to said connecting portion when said detecting portion detects that the potential of said second metal projection is equal to said potential, and then communicates in said first communication procedure; and said processing portion determines that an operation device other than said operation device is connected to said connecting portion, when said detecting portion detects that the potential of said second metal projection is not equal to said potential, and then communicates in said second procedure.

3. An entertainment system as set forth in claim 1, wherein the number of said plurality of recesses is three and said recesses are aligned on the upper surface of said connector.

4. An entertainment system as set forth in claim 1, wherein said predetermined potential is equal to a ground potential and said metal plate is a part of an electromagnetic shield of said connector.

5. An operation device for an entertainment system comprising a connector to be connected to a connecting portion of a machine body, wherein said connector is provided with a plurality of recesses on the peripheral surface thereof to be engaged with projections of said connecting portion, said plurality of recesses include a first recess and a second recess;

said connector includes a metal plate, and said metal plate is exposed inside of said first recess in order to be supplied with a predetermined potential from said projection, and said metal plate is exposed inside of said second recess in order to undergo detection as to the potential of said metal plate by the machine body.

6. An operation device for an entertainment system as set forth in claim 5, wherein said metal plate is a part of an electromagnetic shield of said connector.

7. A machine body of the entertainment system comprising a connecting portion for connecting an operation device thereto wherein:

said connecting portion is provided with a plurality of metal projections to be engaged with a plurality of recessed of a connector of said operation device, said plurality of metal projections include a first metal projection and second metal projection;

said machine body has a supplying portion for supplying a predetermined potential to said first metal projection in order to supply said potential to a metal plate exposed from one of said plurality of recesses of said connector and a detecting portion for detecting whether a potential of said second metal projection is equal to said potential in order to determine whether said metal plate is exposed from another one of said plurality of recesses or not.

8. A machine body of an entertainment system as set forth in claim 7;

wherein said machine body comprises a processing portion that conducts communications with an operation device connected to said connecting portion;

said processing portion is provided with a function to conduct communications in a first and a second communication procedures;

said processing portion communicates with a operation device connected to said connecting portion in said first communication procedure when said detecting portion detects that the potential of said second metal projection is equal to said potential, and communicates with the operation device connected to said connecting portion in said second communication procedure when said detecting portion detects that the potential of said second metal projection is not equal to said potential.

* * * * *

UNITED STATES PATENT AND TRADEMARK OFFICE

CERTIFICATE OF CORRECTION

PATENT NO. : 6,491,550 B1
DATED : December 10, 2002
INVENTOR(S) : Osamu Murasawa It is certified that error appears in the above-identified patent and that said Letters Patent is hereby corrected as shown below:

Column 1,
Line 15, “a” should read -- the --.
Line 27, “oprations” should read -- operations --.
Line 30, “a” should read -- an -- (second occurrence).
Line 57, delete “device”.
Line 59, delete “SUMMARY OF THE INVENTION”.

Column 3,
Line 60, “oprations” should read -- operations --.

Column 8,
Line 25, “the” should read -- an --.
Lines 27, 47 and 51, “An” should read -- The --.
Line 57, immediately after “body” insert -- of the entertainment system --.

Column 9,
Line 1, “An” should read -- The --.
Line 1, “an” should read -- the --.
Line 4, “the” should read -- an --.

Column 10,
Line 1, “A” should read -- The --.
Line 1, “an” should read -- the --.
Line 10, “a” should read -- said --.
Line 15, “the” should read -- said --.

Signed and Sealed this

Twenty-ninth Day of July, 2003

JAMES E. ROGAN
*Director of the United States Patent and Trademark Office*